US006918143B2

(12) United States Patent
Wiberg

(10) Patent No.: US 6,918,143 B2
(45) Date of Patent: Jul. 19, 2005

(54) SEAT WHICH CONVERTS INTO A BED

(76) Inventor: Ole Wiberg, 126 High St., Ramsgate, CT 119 UA, Kent (GB)

( * ) Notice: Subject to any disclaimer, the term of this patent is extended or adjusted under 35 U.S.C. 154(b) by 0 days.

(21) Appl. No.: 10/472,259

(22) PCT Filed: Dec. 14, 2001

(86) PCT No.: PCT/IB01/02827

§ 371 (c)(1),
(2), (4) Date: Sep. 16, 2003

(87) PCT Pub. No.: WO02/074133

PCT Pub. Date: Sep. 26, 2002

(65) Prior Publication Data

US 2004/0083548 A1 May 6, 2004

(30) Foreign Application Priority Data

Mar. 20, 2001 (AT) ..... A 441/2001

(51) Int. Cl.[7] ..... A47C 17/00
(52) U.S. Cl. ..... 5/45; 5/46.1; 5/47
(58) Field of Search ..... 5/45, 46.1, 47, 5/59; 297/380, 382

(56) References Cited

U.S. PATENT DOCUMENTS 1,240,500 A * 9/1917 Sisbower et al. ..... 5/45
2,209,880 A * 7/1940 Fox ..... 5/47
5,549,355 A * 8/1996 Illulian ..... 297/224
6,295,674 B1 * 10/2001 Smith-McKelvey et al. ... 5/690

* cited by examiner

*Primary Examiner*—Heather Shackelford
*Assistant Examiner*—Fredrick Conley
(74) *Attorney, Agent, or Firm*—Herbert Dubno

(57) ABSTRACT

The invention relates to a seat which can be converted into a bed wherein the back of the seat (4) can be pivoted onto the same level as the seating surface (2) by means of arms (3), said arms (3) being connected on one end to the seat frame (1) and on the other end to the back of the seat (4). Said seating surface (2) is covered with a removable upholstery fabric (15) when the furniture item is in a seating position. The upholstery fabric is joined to the front under surface of the seat frame (1) on one side and is joined on the other side to the underside of the back of the seat (4). A double positioning drill (17) is arranged underneath the upholstery fabric (15), extending exclusively along the seating surface which is preferably joined to padding, and is connected thereto on the front end of the seating surface (2). As a result, a simple way of placing the drill is obtained.

9 Claims, 4 Drawing Sheets

SEAT WHICH CONVERTS INTO A BED

CROSS REFERENCE TO RELATED APPLICATIONS

This application is a national stage of PCT/IB01/02827 filed 14 Dec. 2001 and based upon Austrian national application A441/2001 of 20 Mar. 2001 under the International Convention.

FIELD OF THE INVENTION

The invention relates to seating furniture allowing conversion into a bed, where its back rest can be swung into the plane of the seating surface with the aid of linkages and whereby the linkages at one end have a pivot joint to the seat frame and, at the other end, to the back rest.

BACKGROUND OF THE INVENTION

For the protection of upholstery cover material on known furniture of this type, a drill material is placed on the seating surface after conversion into the bed position. The drill material is wound onto a self-retracting roller located behind the article of furniture when it is in the seating position.

OBJECT OF THE INVENTION

It is the object of the invention to provide a simpler way of placing the drill material.

SUMMARY OF THE INVENTION

This object is achieved according to the invention by having the seating surface of the piece of furniture in its seating position covered with loose upholstery cover material which at one side is attached to the front underside of the seating frame and, at the other side, to the underside of the back rest whereby on the underside of the upholstery cover material a double layer of drill material is located which extends across the seating surface only, said upholstery cover material preferably being joined together with wadding and being attached to the front end of the seating surface.

Because of this arrangement, the drill material extends across the entire bed area formed by seat and back rest when the furniture is in the bed position, whereby the upholstery cover material is reversed during the conversion of the furniture into the seating position.

During normal seating on furniture with a back rest, 85% to 90% of body weight is transferred to the seat and only 10% to 15% onto the back rest. Therefore, the seat needs to be a lot more resilient than the back rest. When converting the seat into a bed by utilizing the back rest, the result is a bed area with differing resilience. This, of course, is undesirable.

It is therefore a further object of the invention to provide a piece of furniture of the above-mentioned type which, despite differing resilience of seat area and back rest in the seating configuration, has an at least approximately equal resilience in the bed position.

This is achieved by placing below the upholstery cover material a layer of foam plastics, rubberized hair, coconut fiber or the like.

For a piece of furniture in terms of the invention, the seating area in the seating position becomes resilient due to the relatively resilient foam plastics. When converting it into the bed position, however, this layer is removed from the seating surface and placed onto the back rest which then serves as a bed surface. Thus, one surface (the original seating surface) becomes softer and the adjacent back rest surface firmer.

It is expedient for the layer and the furniture cover material to be sewn together at least at the ends.

In order to avoid the formation of folds, it is advantageous for the layer and the upholstery cover material to be joined with elastic material to the underside of the back rest.

If only the seat and the back rest are used as a bed area, the result is a bed area of only 150 cm in width. The sleeping person or persons then lie along the wall, they are "latitudinal sleepers".

In order to provide access to both sides of the bed, the bed area has to be enlarged by at least one further element; then, the arrangement is a so-called "longitudinal sleeper".

The invention has the further object to create such a longitudinal sleeper in a manner which allows the elements of a latitudinal sleeper to be used whereby the additional element can be attached easily. This is achieved for a piece of furniture of the above-mentioned type in that a further upholstered element is hinged to the rear side of the back rest whereby the hinge is located in the lower area of the back rest and the upholstered surface points to the rear when the piece of furniture is in its seating position.

For a piece of furniture of such a design, the further upholstered element is also swung around when the back rest is swung around and, thus, an adequate bed length is created which points away from the wall. It is expedient if hinged legs are attached to the further upholstered element, which support it on the floor when in the bed position and which are connected via linkages with the back rest such that, when the further upholstered element is swung around, said legs will swing into the support position.

BRIEF DESCRIPTION OF THE DRAWING

In the following, the invention is described in detail with the aid of the embodiment shown in the drawing without being limited to that particular embodiment. Shown are in.

SPECIFIC DESCRIPTION

Figure 4:
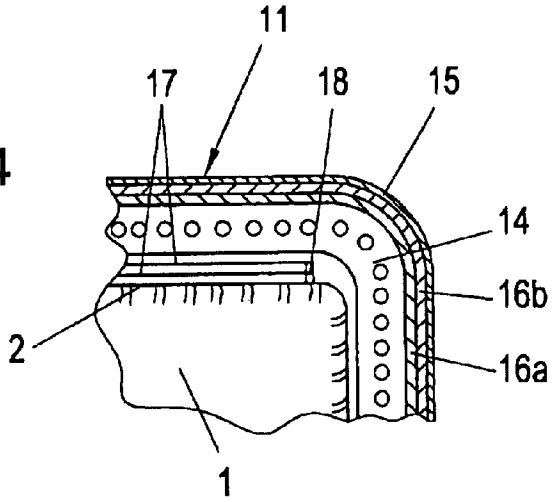
FIG. 4 the front edge of the seating frame with the added layer, shown in an enlarged scale compared to FIGS. 1 to 3.

According to the drawing, a back rest 4 is attached to a seating frame 1 including a seating surface 2 via lateral arms 3 allowing the back rest to pivot. At the rear side of the back rest 4, a further upholstered element 5 is connected with pivot joints whereby the pivot joint 6 is located in the lower area of back rest 4.

On the upholstered element 5, legs 7 are connected to pivot joints with the ends 9 adjacent to bearing 8 having links 10 connected to it which in turn have a pivot joint on back rest 4.

On the seating surface 2, a layer 11 is placed which is attached at one side to a cross member 12 located at the lower front side of seating frame 1 and at the other side with a cross member 13 of back rest 4. It is advantageous to incorporate an elastic element into the connection, e.g. rubber laces. It would also be possible to create an elastic connection via an elastic foam plastics layer.

According to FIG. 4, layer 11 consists of a foam plastics layer 14 and an upholstery fabric 15 placed on top whereby a lining material 16 can be placed between the foam plastics layer 14 and upholstery fabric 15. Below the foam plastics layer 14 in the area of the seating surface 2 only, there is a double layer 17 of drill material which can have wadding attached to it. At the reversal point 18 of the double layer 17, said layer is attached to seating surface 2, in particular by stitching.

Figure 1:
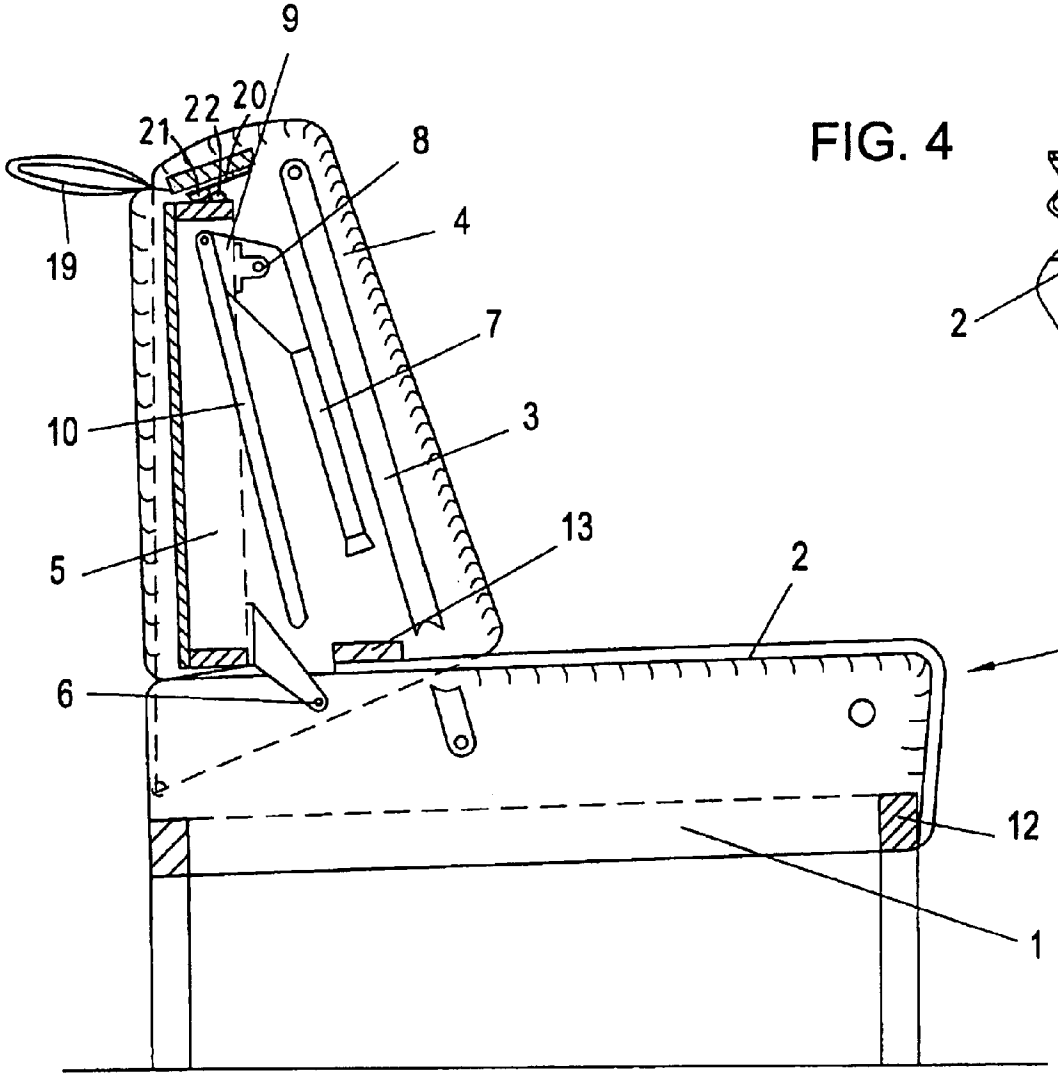
FIG. 1 the partially sectioned side view of a piece of furniture in terms of the invention in the seating position.
Figure 2:
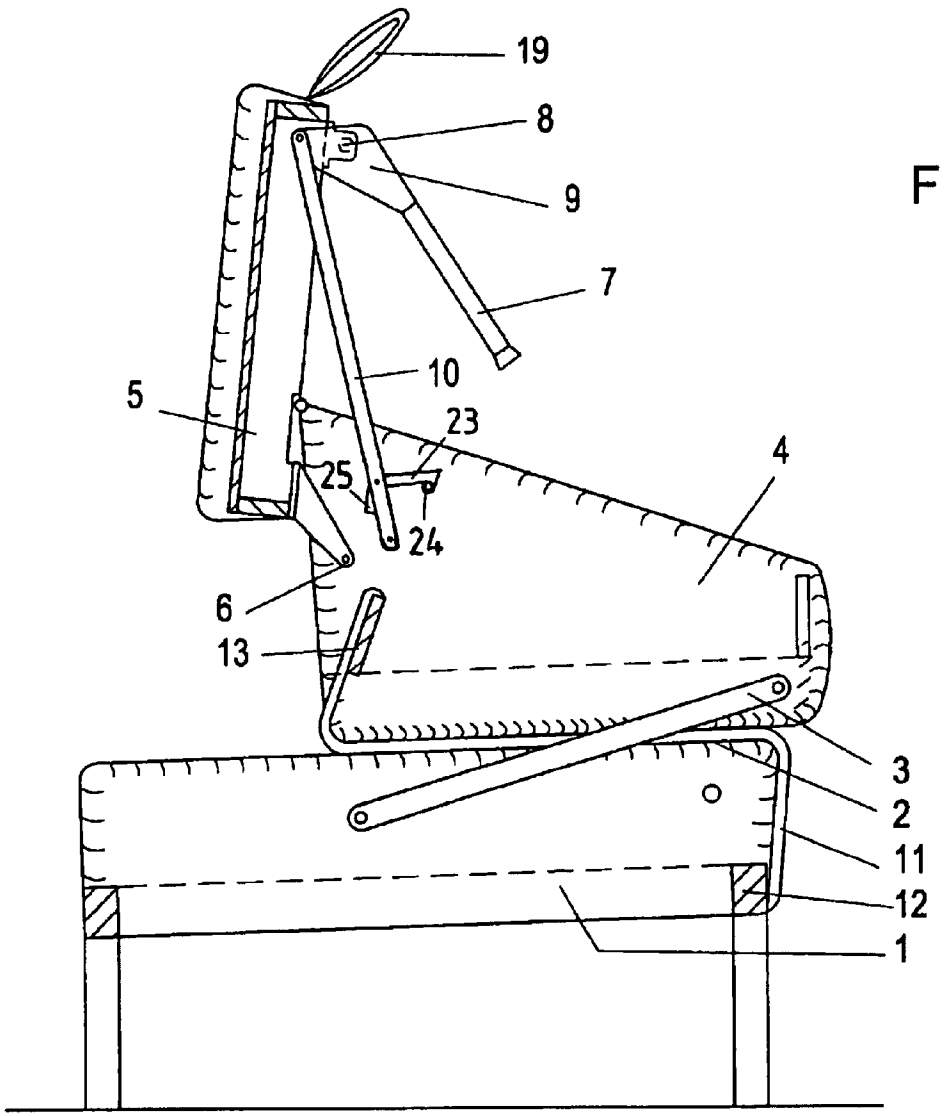
FIG. 2 this piece of furniture in an intermediate position with, opened storage for bedding.
Figure 3:
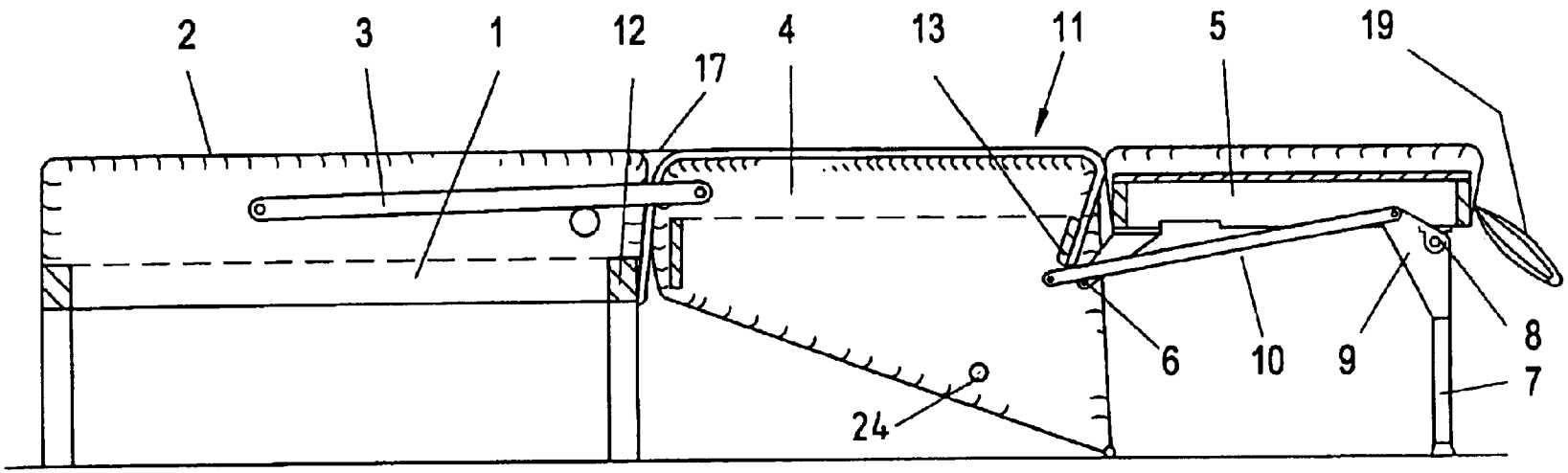
FIG. 3 the piece of furniture in the bed position.
Figure 5:
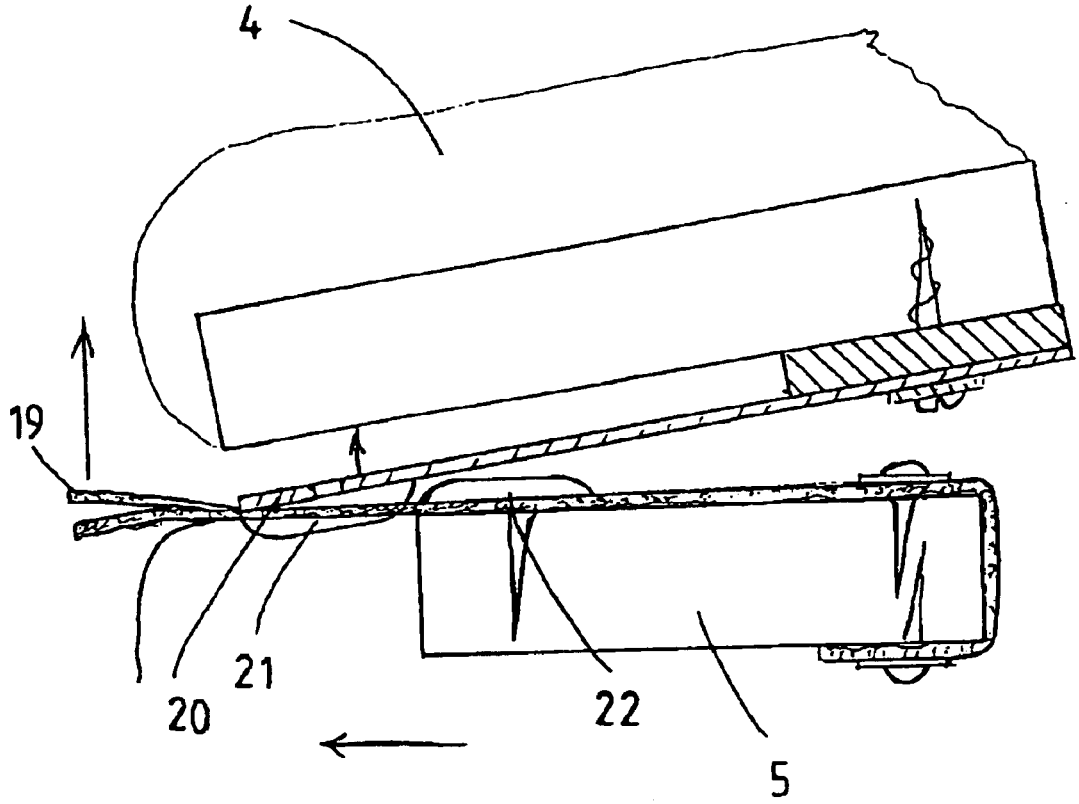
FIG. 5 the area back rest—further upholstered element in an enlarged scale.

If the piece of furniture is to be changed from the seating position shown in FIG. 1 to the bed position as per FIG. 3, the loop handle 19 of upholstered element 5 is pulled which swings back rest 4 into a new position. As can be seen in FIG. 5, further pulling of loop handle 19 towards the front results in a movement of a sprung plate 20 attached to the inside of back rest 4. That has the effect of dis-engaging a sliding pin 21, attached to sprung plate 20, from a sliding stop pin 22 located on upholstered element 5. Eventually, the intermediate position according to FIG. 2 is obtained. At the same time, a spring-loaded hook 23 attached to link 10 with a pivot joint snaps onto pin 24 and the angle between back rest 4 and upholstered element 5 is fixed.

In this position, access to the bedding storage space is available which is located behind back rest 4. No further handling operations are required which is another advantage of the invention.

After pulling the loop handle 19 further towards the front, back rest 4 as well as upholstered element 5 swing into the bed position shown in FIG. 3. During this unfolding operation, layer 11 is pulled along by back rest 4 and placed onto this back rest while being reversed. Thus, the previous seating surface 2, which has now become part of the bed surface, becomes softer and the back rest 4, which now forms the middle part of the bed surface, becomes firmer.

At the same time, the upper layer of double layer 17 is swung around reversal point 18 and placed onto foam plastics layer 14. The legs 7 swing around their bearing 8 and support upholstered element 5 on the floor.

For the purposes of converting the unit from the bed into the seating position, a pawl 25 is attached to spring-loaded hook 23 with a pivot point. Then, pin 24 moves towards pawl 25 which in turn swings against hook 23 and lifts it so that pin 24 can travel past.

The invention provides the opportunity to make a varied offer available to the consumer because the individual elements allow various configurations. Thus, the piece of furniture described above can be manufactured and used without the additional upholstered element 5 without the requirement for significant set-up changes on the production line. If an additional folding bed on rollers is used, which can be stored under the seating frame the application range of the piece of furniture in terms of the invention can be extended further. Without a folding bed on rollers, the bed in terms of the invention has clear space underneath, a characteristic much valued by users.

The possible use of the individual elements in various combinations also offers great advantages for marketing. As is well known, word of mouth is the best advertising and if one configuration is well received, then this assessment will also extend to other configurations.

What is claimed is:

1. An article of furniture convertible from seating to a bed, said article of furniture comprising:

a seating portion having a seating frame and a seating surface lying in a plane;

a back rest connected to said frame and having arms pivotally connected to the back rest and to the frame (1) and enabling said back rest to assume an upright position at a rear of said seating surface in a seating position in which an underside of said back rest lies on said rear of said seating surface and a bed position in which a back of said back rest is coplanar with said seating surface;

an upholstery fabric attached at one side to a front underside of said seating frame and at an opposite side to the underside of said back rest, whereby said upholstery fabric covers said seating surface in said seating position and an upper side of said upholstery fabric is exposed in said seating position; and a double layer of a drill material extending in said seating position only over said seating surface and underlying said upholstery fabric in said seating position, but secured to said underside of said backrest so as to stretch in a single layer over said seating surface and said back of said back rest in said bed position.

2. The article of furniture defined in claim 1 wherein said drill material is provided with a layer of wading.

3. The article of furniture defined in claim 2 wherein along the underside of the upholstery fabric a layer of a material selected from the group which consists of foam plastic, rubberized hair, and coconut fiber is provided.

4. The article of furniture defined in claim 3 wherein said layer underlying said upholstery fabric and said upholstery fabric are stitched together.

5. The article of furniture defined in claim 3 wherein said layer underlying said upholstery fabric and said upholstery fabric are attached to the underside of said back rest with an elastic element.

6. The article of furniture defined in claim 1, further comprising an upholstered element connected by a pivot joint with said back rest and swingable outwardly therefrom to provide an upholstered surface disposed behind said back rest in said seating position and extending coplanar with said seating surface and said back rest in said bed position.

7. The article of furniture defined in claim 6, further comprising legs pivotally connected to said element and supporting said element on a floor in said bed position, and arms connected to said legs for swinging said legs outwardly from said element when said element is swung into said bed position.

8. The article of furniture defined in claim 7, further comprising a plate cooperating with a sliding stop pin on said element.

9. The article of furniture defined in claim 7 wherein at least one of said arms is provided with a hook attached to a pivot joint and snapping onto a pin on said back rest upon conversion of the article between said position.

* * * * *